United States Patent [19]

Opitz et al.

[11] Patent Number: 4,622,078

[45] Date of Patent: Nov. 11, 1986

[54] PROCESS FOR THE ZINC/CALCIUM PHOSPHATIZING OF METAL SURFACES AT LOW TREATMENT TEMPERATURES

[75] Inventors: Reinhard Opitz, Duren; Manfred Breuer, Pulheim, both of Fed. Rep. of Germany

[73] Assignee: Gerhard Collardin GmbH, Cologne, Fed. Rep. of Germany

[21] Appl. No.: 703,251

[22] Filed: Feb. 20, 1985

[30] Foreign Application Priority Data

Mar. 1, 1984 [DE] Fed. Rep. of Germany ..... 3407513

[51] Int. Cl.[4] ..... C23C 22/12

[52] U.S. Cl. ..... 148/6.15 Z

[58] Field of Search ..... 148/6.15 Z

[56] References Cited

U.S. PATENT DOCUMENTS 4,419,199 12/1983 Hauffe et al. ..... 204/181 R
4,498,935 2/1985 Kent et al. ..... 148/6.15 Z

FOREIGN PATENT DOCUMENTS 1521818 10/1969 Fed. Rep. of Germany .
2232067 1/1973 Fed. Rep. of Germany .
2540684 3/1977 Fed. Rep. of Germany .
3118375 11/1982 Fed. Rep. of Germany .
0811220 6/1974 France .
1040020 8/1966 United Kingdom .
1555529 11/1979 United Kingdom .
2080835 2/1982 United Kingdom ..... 148/6.15 Z

OTHER PUBLICATIONS

A. Neuhaus & M. Gebhart, Werkstoffe und Korrosion, 567 (1966).

*Primary Examiner*—Sam Silverberg
*Attorney, Agent, or Firm*—Ernest G. Szoke; Nelson Littell, Jr.; Henry E. Millson, Jr.

[57] ABSTRACT

The invention relates to a process for phosphatizing metal surfaces with an acidic phosphatizing solution containing zinc ions, calcium ions, phosphate ions and accelerators and, optionally, other additives, characterized in that, after degreasing and without activation, the metal surfaces are brought into contact at 30° to 65° C. with solutions which contain $Zn^{2+}$, $Ca^{2+}$, $PO_4^{3-}$ and, as accelerators, nitrate and/or nitrite and/or chlorate ions and/or an organic nitro compound and/or $H_2O_2$ or an inorganic peroxide and which have a pH-value of from 2.2 to 3.8, a ratio of free acid to toal acid of from 1:10 to 1:60 and a ratio by weight of $(Ca^{2+}+Zn^{2+})$ to $PO_4^{3-}$ of from 1:>8 to 1:40, and to the use of this process for pretreating the metal surfaces for painting by electrodeposition, particularly by cathodic electrodeposition.

14 Claims, No Drawings

PROCESS FOR THE ZINC/CALCIUM PHOSPHATIZING OF METAL SURFACES AT LOW TREATMENT TEMPERATURES

This invention relates to a process for the phosphatizing of metal surfaces, particularly surfaces of iron, steel, zinc and/or aluminum, with a phosphatizing solution containing zinc, calcium, phosphate and accelerators and, optionally, other additives and to the use of this process for pretreating the metal surfaces for painting by electrodeposition, particularly by cathodic electrodeposition.

The protection of metal surfaces, particularly the protection of iron and steel surfaces, by phosphate-containing coatings has been known for some time. In this connection, a distinction is drawn between so-called "non-layer-forming phosphatizing", i.e. the use of alkali metal and/or ammonium orthophosphate solutions to produce iron phosphate coatings in which the iron ion emanates from the metal surface to be coated, and so-called "layer-forming phosphatizing", in which zinc phosphate layers or zinc/calcium phosphate layers are formed on metal surfaces using zinc or zinc/calcium phosphate solutions.

Phosphate coatings such as these not only improve the corrosion inhibition of the metal surfaces, they also increase the adhesion of lacquers subsequently applied to the surface. In addition, they are able in certain cases to contribute towards improving the properties of metal sheets for cold forming and for deep drawing. Zinc/calcium phosphate solutions are being used to an increasing extent, particularly for the phosphatizing of metal surfaces which are to be subsequently coated with electrodeposition lacquers. In this connection, experience of the composition of the bath solutions on the one hand and basic knowledge of the structure of phosphatizing layers on the other hand (A. Neuhaus and M. Gebhart, Werkstoffe und Korrosion, 567 (1966)) have shown that the structure of uniform, uninterrupted phosphate coatings depends not only on the composition of the bath solutions, but also upon the pretreatment of the starting metal sheets, upon the activation before the phosphatizing steps, upon the choice of a suitable accelerator and upon other process parameters.

German published application DE-OS No. 15 21 818 and its corresponding British patent GB PS No. 1,040,020 describes aqueous phosphatizing solutions which contain as their principal constituents zinc, calcium, nickel, phosphate, nitrite and nitrate ions and which may be used for phosphatizing galvanized iron surfaces at elevated temperatures. However, one disadvantage of this known phosphatizing solution is that the temperature at which the phosphatizing step is carried out has to be relatively high if the solutions are to be able to be applied quickly in economically reasonable times. For total immersion times of from 1 to 20 seconds, the temperatures are in the range from 66° to 116° C. The solutions used have very high contents of zinc and calcium ions for a low phosphate ion content. The ratio by weight of the sum of zinc and calcium ions to phosphate ions is in the range from 1:3.5 to 1:7.1.

Aqueous phosphatizing solutions containing zinc, calcium, phosphate and, optionally, also nickel ions and, in addition, $H_2O_2$ as accelerator are described in BE-PS No. 811 220. However, the temperatures at which solutions such as these are applied are again relatively high.

In relation to the phosphate content, the content of zinc and calcium ions is very high.

Processes for phosphatizing metal surfaces with acidic zinc phosphate solutions containing oxidizing agents in which a comparatively low zinc content contrasts with a distinctly higher phosphate content and which may contain other divalent metal ions for example even $Ca^{2+}$-ions, are described in DE-AS No. 22 32 067 and in DE-OS No. 31 18 375, corresponding to U.S. Pat. No. 4,419,199. Although it is possible by the process according to DE-AS No. 22 32 067 to produce high-quality phosphate coatings with fresh phosphate solutions, the quality of corrosion prevention deteriorates after a relatively large number of sheets have been treated on account of irregular phosphate coatings. In some cases, the protective coatings formed are of no use whatever.

Another disadvantage of most known phosphatizing processes lies in the fact that the quality of the heavy metal phosphate coatings formed in the phosphatizing step depends to a very large extent upon the degreasing pretreatment of the metal surfaces and also upon their activation. In particular, considerable significance is attributed to the activation step insofar as it represents the basis for the adhesion of the subsequent phosphate coatings and hence has a considerable bearing upon the quality of the phosphate coatings formed. The desired formation of thin, fine-grained crystalline phosphate coatings is only possible after adequate activation by suitable activating agents, for example phosphate-containing activating solutions. In this connection, there is the particular difficulty of avoiding speckle formation which adversely affects the quality of the phosphate coating.

OBJECTS OF THE INVENTION

An object of the present invention is to develop a process for obtaining thin, fine-grained crystalline zinc/calcium phosphate coatings of high homogeneity on metal surfaces, at low treatment temperatures.

Another object of the present invention is the development of a process for phosphatizing metal surfaces with an acidic phosphatizing solution containing zinc ions, calcium ions, phosphate ions and accelerators consisting essentially of contacting said metal surfaces after degreasing and without activation with an aqueous solution at a temperature of from 30° to 65° C., said aqueous solution containing (a) more than 0.5 to 1.5 $g.l^{-1}$ of $Ca^{2+}$,
(b) 0.5 to 1.5 $g.l^{-1}$ of $Zn^{2+}$,
(c) 10 to 50 $g.l^{-1}$ of $PO_4^{3-}$,
(d) at least one accelerator selected from the group consisting of:
  0.5 to 30 $g.l^{-1}$ of $NO_3^-$,
  0.01 to 0.6 $g.l^{-1}$ of $NO_2^-$,
  0.2 to 10 $g.l^{-1}$ of $ClO_3^-$,
  0.1 to 2 $g.l^{-1}$ of an organo nitro compound,
  0.01 to 0.5 $g.l^{-1}$ of an inorganic peroxide or hydrogen peroxide,
  and mixtures thereof which aqueous solution having a pH of from 2.2 to 3.8, a ratio of free acid to total acid of from 1:10 to 1:60 and a ratio by weight of $(Ca^{2+}+Zn^{2+})$ to $PO_4^{3-}$ of from 1:>8 to 1:40.

A yet further object of the present invention is the obtaining of an aqueous acidic phosphatizing solution for treating metal surfaces after degreasing and without activation at a temperature of from 30° to 65° C. consisting essentially of (a) more than 0.5 to 1.5 $g.l^{-1}$ of $Ca^{2+}$, (b) 0.5 to 1.5 $g.l^{-1}$ of $Zn^{2+}$, (c) 10 to 50 $g.l^{-1}$ of $PO_4^{3-}$, (d) at least one accelerator selected from the group consisting of 0.5 to 30 $g.l^{-1}$ of $NO_3^-$ 0.01 to 0.6 $g.l^{-1}$ of $NO_2^-$, 0.2 to 10 $g.l^{-1}$ of $ClO_3^-$, 0.1 to 2 $g.l^{-1}$ of an organo nitro compound, 0.01 to 0.5 $g.l^{-1}$ of an inorganic peroxide or hydrogen peroxide, and mixtures thereof, which aqueous solution has a pH of from 2.2 to 3.8, a ratio of free acid to total acid of from 1:10 to 1:60 and a ratio by weight of $(Ca^{2+}+Zn^{2+})$ to $PO_4^{3-}$ of from 1:>8 to 1:40.

These and other objects of the invention will become more apparent as the description thereof proceeds.

DESCRIPTION OF THE INVENTION

It has now surprisingly been found that the above objects can be achieved and that thin, fine-grained crystalline zinc/calcium phosphate coatings of high homogeneity can be obtained, even at low treatment temperatures, if the metal surfaces are treated with acidic aqueous solutions containing zinc, calcium and phosphate ions and also one or more accelerators, where a narrow pH-range, a certain acid ratio and a predetermined ratio by weight of the sum of calcium and zinc ions to phosphate ions, have to be maintained.

Accordingly, the present invention relates to a process for phosphatizing metal surfaces, particularly surfaces of iron, steel, zinc and/or aluminum, with an acidic phosphating solution containing zinc ions, calcium ions, and phosphate ions and accelerators and, optionally, other additives, characterized in that, after degreasing and without activation, the surfaces are brought into contact at 30° to 65° C. with solutions which contain more than 0.5 to 1.5 $g.l^{-1}$ of $Ca^{2+}$, 0.5 to 1.5 $g.l^{-}$of $Zn^{2+}$, 10 to 50 $g.l^{-}$of $PO_4^{3-}$ and, as accelerator, 0.5 to 30 $g.l^{-1}$ of $NO_3^-$ and/or 0.01 to 0.6 $g.l^{-}$of $NO_2^-$ and/or 0.2 to 10 $g.l^{-}$of $ClO_3^-$ and/or 0.1 to 2 $g.l^{-1}$ of an organic nitro compound and/or 0.01 to 0.5 $g.l^{-}$of $H_2O_2$ or of an inorganic peroxide and which solutions have a pH value of from 2.2 to 3.8, a ratio of free acid to total acid of from 1:10 to 1:60 and a ratio by weight of $(Ca^{2+}+Zn^{2+})$ to $PO_4^{3-}$ of from 1:>8 to 1:40.

More particularly, the present invention relates to a process for phosphatizing metal surfaces with an acidic phosphatizing solution containing zinc ions, calcium ions, phosphate ions and accelerators consisting essentially of contacting said metal surfaces after degreasing and without activation with an aqueous solution at a temperature of from 30° to 65° C., said aqueous solution containing (a) more than 0.5 to 1.5 $g.l^{-1}$ of $Ca^{2+}$, (b) 0.5 to 1.5 $g.l^{-1}$ of $Zn^{2+}$, (c) 10 to 50 $g.l^{-1}$ of $PO_4^{3-}$, (d) at least one accelerator selected from the group consisting of:

0.5 to 30 $g.l^{-1}$ of $NO_3^-$, 0.01 to 0.6 $g.l^{-1}$ of $NO_2^-$, 0.2 to 10 $g.l^{-1}$ of $ClO_3^-$, 0.1 to 2 $g.l^{-1}$ of an organo nitro compound, 0.01 to 0.5 $g.l^{-1}$ of an inorganic peroxide or hydrogen peroxide, and mixtures thereof which aqueous solution having a pH of from 2.2 to 3.8, a ratio of free acid to total acid of from 1:10 to 1:60 and a ratio by weight of $(Ca^{2+}+Zn^{2+})$ to $PO_4^{3-}$ of from 1:>8 to 1:40.; as well as the aqueous, acidic phosphatizing solution.

The present invention also relates to the use of this process for pretreating the metal surfaces for painting by electrodeposition, more particularly by cathodic electrodeposition.

The process according to the invention is particularly suitable for phosphatizing metal surfaces of iron, steel and zinc. However, surfaces of aluminum may also be coated with zinc/calcium layers by the process according to the invention.

It has been found that the treated metal surfaces become coated with a layer of dizinc calcium phosphate dihydrate (scholzite). Although zinc and calcium ions are incorporated in the phosphate coating in a molar ratio of 2:1, it is crucial to the composition of the bath solutions used in the process according to the invention that they contain zinc and calcium ions in a ratio by weight of from 1:0.5 to 1:1.5 preferably in a ratio of 1:1 to 1:1.5 and particularly in a ratio of 1:1.

To this end, suitable water-soluble zinc and calcium salts or solutions are added to the solutions so that the content of $Zn^{2+}$ amounts to between 0.5 and 1.5 $g.l^{-1}$, preferably from 0.7 to 1.4 $g.l^{-}$of the phosphatizing solution and the content of $Ca^{2}+$ amounts to more than 0.5 to 1.5 $g.l^{-}$, such as 0.52 to 1.5 $g.l^{-}$, preferably 0.6 to 1.3 $g.l^{-1}$ of the phosphatizing solution. More particularly, ZnO, phosphoric acid and $Ca(NO_3)_2{:}4H_2O$ are used as starting compounds.

The proportion of $PO_4^{3-}$-ions, adjustable through phosphoric acid, in the phosphating solutions according to the invention is considerably higher, amounting to between 10 and 50 $g.l^{-1}$, preferably between 20 and 35 $g.l^{-1}$.

Accordingly, the indicated quantities of the active ions forming the principal constituents of the phosphatizing solutions according to the invention are characterized in that the ratio by weight of the sum of calcium and zinc ions to phosphate ions is always in the range from 1:>8 to 1:40, preferably from 1:8.2 to 1:20. This ensures that homogeneous scholzite layers are formed on all the metal surfaces treated. The formation of, for example, tertiary zinc phosphate tetrahydrate (hopeite) or dizinc iron phosphate tetrahydrate (phosphophyllite), which together with scholzite would lead to a less homogeneous and less firmly adhering protective layer, is not observed.

Another important process parameter is the molar ratio of free acid to total acid (acid ratio) which has to be adjusted to values of from 1:10 to 1:60, preferably from 1:15 to 1:50. This means in particular that a relatively low value for the concentration of free acid is particularly important to the formation of good scholzite layers.

The pH of the acidic phosphatizing solutions is maintained between 2.2 and 3.8, preferably between 2.8 and 3.7.

From 0.5 to 30 $g.l^{-1}$, preferably 2 to 10 $g.l^{-1}$, of nitrate ions and/or from 0.01 to 0.6 $g.l^{-1}$, preferably 0.05 to 0.2 $g.l^{-1}$, of nitrite ions, and/or from 0.2 to 10 $g.l^{-1}$, preferably 0.5 to 4 $g.l^{-1}$ of chlorate ions, and/or from 0.1 to 2 $g.l^{-1}$, preferably 0.4 to 1 $g.l^{-1}$ of organic nitro compounds, and/or from 0.01 to 0.5 $g.l^{-1}$ of inorganic peroxides or $H_2O_2$ are added as accelerating oxidizing agents to the phosphatizing solutions for the process according to the invention.

If aluminum surfaces are to be phosphatized by the process according to the invention, simple and/or complex fluorides may be added to the bath solutions in a quantity of from 0.01 to 2 $g.l^{-1}$ in order to complex even very small quantities of aluminum, which could enter the bath from the metal surface and impair its effectiveness, by fluoride ions.

The phosphating solutions with which metal surfaces are phosphated by the process according to the invention may also contain other metal ions, for example $Ni^{2+}$. Their content is in the range from 0.01 to 1.5 $g.l^{-1}$ of bath solution.

The treatment of the iron, steel, zinc and/or aluminum surfaces by the process according to the invention may be carried out by spraying, immersion or even flooding. However, combined processes, such as spray-immersion for example, may be used with equally good results. The times for which the phosphating solutions are in contact with the metal surfaces are between 60 and 240 seconds. In the case of spraying for example, the contact times are between 60 and 180 seconds and, in the case of immersion, between 90 and 240 seconds. However, considerably shorter treatment times are also possible.

According to the invention, the metal surfaces are treated with the phosphatizing solutions at temperatures in the range from 30° to 65° C. Preferred treatment temperatures are in the range from 48° to 57° C.

One of the major advantages of the process according to the invention is that the scholzite layers are formed on the metal surfaces completely irrespective of the method used to clean them before the phosphatizing step. Where the process according to the invention is applied, therefore, there is complete freedom of choice in regard to the degreasing and cleaning agents used.

Another advantage lies in the fact that particularly thin, fine-grained crystalline phosphate coatings are obtained even without the use of activating agents of the type commonly used in known processes. Not only does this save at least one process step before the phosphatizing step, it also saves the raw materials required for that process step, such as for example titanium phosphates which are used as activating agents.

The process according to the invention makes it possible to obtain excellent protective layers between 0.5 and 5 μm thick which are eminently suitable for use as a substrate for electrodeposition paints, particularly cathodic electrodeposition paints of the type being used to an increasing extent in the automotive industry. However, the phosphate coatings obtained in accordance with the invention are also suitable for use as a substrate for other organic protective surface layers.

The invention is illustrated by the following Examples.

The phosphatizing solutions according to the invention were prepared in known manner by combining the required components, particularly concentrates containing zinc oxide, phosphoric acid and calcium nitrate tetrahydrate, salts and solutions, followed by dilution with water to the concentrations according to the invention.

EXAMPLE 1

A phosphatizing solution containing 1.0 $g.l^{-1}$ of $Ca^{2+}$
1.2 $g.l^{-1}$ of $Zn^{2+}$
29.5 $g.l^{-1}$ of $PO_4^{3-}$
1.0 $g.l^{-1}$ of $ClO_3^-$
3.2 $g.l^{-1}$ of $NO_3^-$
0.1 $g.l^{-1}$ of $NO_2^-$ was prepared. The phosphating solution had the following characteristics:

pH-value: approx. 3.1
Acid ratio: approx. 1:19
$\Sigma Ca^{2+}+Zn^{2+}:PO_4^{3-}=1:13.4$ Steel sheets which had been cleaned by immersion for 3 minutes at 50° C. in an alkaline cleaning solution and then rinsed with water were immersed in the above-mentioned phosphatizing solution for 4 minutes at 55° C. They were rinsed with water and distilled water and dried.

The phosphate coatings obtained were finely crystalline and non-porous.

The sheets were then coated with a cathodic electrodeposition paint and dried for 20 minutes by heating at 185° C. The dry film thickness of the paint amounted to 18 μm.

The sheets were then provided with a single cut in accordance with DIN 53167 and salt-spray tested for 480 h in accordance with DIN 50021. Evaluation in accordance with DIN 53167 revealed a creepage value of <0.1 mm.

This Example shows that the process according to the invention gives good phosphate coatings.

EXAMPLE 2

A phosphatizing solution containing:

0.6 $g.l^{-1}$ of $Ca^{2+}$
0.7 $g.l^{-1}$ of $Zn^{2+}$
22.6 $g.l^{-1}$ of $PO_4^{3-}$
0.3 $g.l^{-1}$ of $Ni^{2+}$
2.7 $g.l^{-1}$ of $NO_3^-$
0.5 $g.L^{-1}$ of $F^-$
0.1 $g.l^{-1}$ of $NO_2^-$ was prepared. The phosphatizing solution had the following characteristics:

pH-value: approx 3.3
Acid ratio: approx. 1:39
$\Sigma Ca^{2+}+Zn^{2+}:PO_4^{3-}=1:17.4$ Steel plates which had been sprayed with an alkaline cleaning solution for 60 seconds at 45° C. were sprayed with the above-mentioned phosphatizing solution for 90 seconds at 48° C. They were rinsed with water and distilled water and dried with compressed air.

The phosphate coatings obtained were finely crystalline and non-porous.

The sheets were then coated with a cathodic electrodeposition paint and dried by heating for 20 minutes at 185° C. The dry film thickness of the paint amounted to 18 μm.

The sheets were then provided with a single cut in accordance with DIN 53167 and salt-spray tested for 480 h in accordance with DIN 50021. Evaluation in accordance with DIN 53167 produced a creepage value of <0.1 mm.

This Example demonstrates that the process according to the invention gives good phosphate coatings.

EXAMPLE 3

A phosphatizing solution containing 1.3 $g.l^{-1}$ of $Ca^{2+}$
1.3 $g.l^{-1}$ of $Zn^{2+}$
21.2 $g.l^{-1}$ of $PO_4^{3-}$
1.0 $g.l^{-1}$ of $Ni^{2+}$
2.2 $g.l^{-1}$ of $ClO_3^-$ 0.6 $g.l^{-1}$ of sodium nitrobenzene sulfonate was prepared. The phosphatizing solution had the following characteristics:

pH-value: approx. 2.9

Acid ratio: approx. 1:18.6

$\Sigma Ca^{2+}+Zn^{2+}:PO_4^{3-}=1:8.2$

Electrogalvanized steel sheets which had been immersed for 3 minutes at 50° C. in an alkaline cleaning solution and subsequently rinsed with water were immersed in the above-mentioned phosphatizing solution for 3 minutes at 57° C. They were then rinsed with water and distilled water and dried with compressed air.

The phosphate coatings produced were finely crystalline and non-porous.

The sheets were then coated with a cathodic electrodeposition paint and dried by heating for 20 minutes at 185° C. The dry film thickness of the paint amounted to 18 μm.

The sheets were then provided with a single cut in accordance with DIN 53167 and salt-spray tested for 480 h in accordance with DIN 50021. Evaluation in accordance with DIN 53167 produced a creepage value of <0.1 mm.

This Example shows that the process according to the invention gives good phosphate coatings.

EXAMPLE 4

A phosphatizing solution containing 1.0 $g.l^{-1}$ of $Ca^{2+}$ 1.4 $g.l^{-1}$ of $Zn^{2+}$ 26.6 $g.l^{-1}$ of $PO_4^{3-}$ 3.2 $g.l^{-1}$ of $NO_3^-$ 0.1 $g.l^{-1}$ of $NO_2^-$ was prepared. The phosphatizing solution had the following characteristics:

pH-value: approx. 3.6

Acid ratio: approx. 1:48

$\Sigma Ca^{2+}+Zn^{2+}:PO_4^{3-}=1:11.1$

Steel sheets which had been sprayed with an alkaline cleaning solution for 60 seconds at 45° C. were sprayed with the above-mentioned phosphatizing solution for 120 seconds at 35° C. They were then rinsed with water and distilled water and dried with compressed air.

The phosphate coatings formed were finely crystalline and non-porous.

The sheets were then coated with a cathodic electrodeposition paint and dried by heating for 20 minutes at 185° C. The dry film thickness of the paint amounted to 18 μm.

The sheets were then provided with a single cut in accordance with DIN 53167 and salt-spray tested for 480 h in accordance with DIN 50021. Evaluation in accordance with DIN 53167 produced a creepage value of 0.2 mm.

This Example shows that the process according to the invention gives good phosphate coatings.

COMPARISON EXAMPLE

A phosphatizing solution was prepared in accordance with GB-PS No. 10 40 020, page 3 (solution B).

Steel sheets which had been cleaned with an alkaline cleaning solution for 30 seconds at 72° C. were sprayed with the above-mentioned phosphatizing solution for 60 seconds at 66° C. They were then rinsed with water and distilled water and dried with compressed air. The phosphate coatings obtained were coarsely crystalline and not entirely non-porous.

The sheets were then coated with a cathodic electrodeposition paint and dried by heating for 20 minutes at 185° C. The dry film thickness of the paint amounted to 18 μm.

The sheets were then provided with a single cut in accordance with DIN 53167 and salt-spray tested for 480 h in accordance with DIN 50021. Evaluation in accordance with DIN 53167 produced a creepage value of from 4 to 6 mm.

This comparison Example shows that, in contrast to the Examples according to the invention, distinctly inferior corrosion prevention is obtained.

The preceding specific embodiments are illustrative of the practice of the invention. It is to be understood however, that other expedients known to those skilled in the art or disclosed herein may be employed without departing from the spirit of the invention or the scope of the appended claims.

We claim:

1. A process for phosphatizing metal surfaces with an acidic phosphatizing solution containing zinc ions, calcium ions, phosphate ions and accelerators consisting essentially of contacting said metal surfaces after degreasing and without activation with an aqueous solution at a temperature of from 30° to 65° C., said aqueous solution containing (a) more than 0.5 to 1.5 $g.l^{-1}$ of $Ca^{2+}$, (b) 0.5 to 1.5 $g.l^{-1}$ of $Zn^{2+}$, (c) 10 to 50 $g.l^{-1}$ of $PO_4^{3-}$, (d) at least one accelerator selected from the group consisting of:

0.5 to 30 $g.l^{-1}$ of $NO_3^-$, 0.01 to 0.6 $g.l^{-1}$ of $NO_2^-$, 0.2 to 10 $g.l^{-1}$ of $ClO_3^-$, 0.1 to 2 $g.l^{-1}$ of an organo nitro compound, 0.01 to 0.5 $g.l^{-1}$ of an inorganic peroxide or hydrogen peroxide, and mixtures thereof which aqueous solution having a pH of from 2.2 to 3.8, a ratio of free acid to total acid of from 1:10 to 1:60 and a ratio by weight of $(Ca^{2+}+Zn^{2+})$ to $PO_4^{3-}$ of from 1:>8 to 1:40 and wherein the weight ration of zinc ions to calcium ions is from 1:0.5 to 1:1.5.

2. The process of claim 1 wherein said weight ratio is from 1:1 to 1:1.5.

3. The process of claim 2 wherein said weight ratio is 1:1.

4. The process of claim 1 wherein said aqueous solution further contains from 0.01 to 1.5 $g.l^{-1}$ of $Ni^{2+}$.

5. The process of claim 1 wherein said aqueous solution further contains from 0.01 to 2 $g.l^{-1}$ of $F^-$.

6. The process of claim 4 wherein said aqueous solution further contains from 0.01 to 2 $g.l^{-1}$ of $F^-$.

7. The process of claim 1 wherein said temperature is from 48° to 57° C.

8. The process of claim 1 wherein said contacting said metal surfaces is by immersion, spraying, flooding or by combined processes.

9. An aqueous acidic phosphatizing solution for treating metal surfaces after degreasing and without activation at a temperature of from 30° to 65° C. consisting essentially of (a) more than 0.5 to 1.5 $g.l^{-1}$ of $Ca^{2+}$, (b) 0.5 to 1.5 $g.l^{-1}$ of $Zn^{2+}$, (c) 10 to 50 $g.l^{-1}$ of $PO_4^{3-}$, (d) at least one accelerator selected from the group consisting of 0.5 to 30 $g.l^{-1}$ of $NO_3^-$ 0.01 to 0.6 $g.l^{-1}$ of $NO_2^-$, 0.2 to 10 $g.l^{-1}$ of $ClO_3^-$, 0.1 to 2 $g.l^{-1}$ of an organo nitro compound, 0.01 to 0.5 $g.l^{-1}$ of an inorganic peroxide or hydrogen peroxide, and mixtures thereof, which aqueous solution has a pH of from 2.2 to 3.8, a ratio of free acid to total acid of from 1:10 to 1:60 and a ratio by weight of $(Ca^{2+}+Zn^{2+})$ to $PO_4^{3-}$ of from 1:>8 to 1:40 and wherein the weight ratio of zinc ions to calcium ions is from 1:0.5 to 1:1.5.

10. The aqueous solution of claim 10 wherein said weight ratio is from 1:1 to 1:1.5.

11. The aqueous solution of claim 10 wherein said weight ratio is 1:1.

12. The aqueous solution of claim 9 wherein said aqueous solution further contains from 0.01 to 1.5 $g.l^{-1}$ of $Ni^{2+}$.

13. The aqueous solution of claim 9 wherein said aqueous solution further contains from 0.01 to 2 $g.l^{-1}$ of $F^-$.

14. The aqueous solution of claim 12 wherein said aqueous solution further contains from 0.01 to 2 $g.l^{-1}$ of $F^-$.

* * * * *